US009368126B2

(12) United States Patent
Qin et al.

(10) Patent No.: US 9,368,126 B2
(45) Date of Patent: Jun. 14, 2016

(54) ASSESSING SPEECH PROSODY

(75) Inventors: Yong Qin, Beijing (CN); Qin Shi, Beijing (CN); Zhiwei Shuang, Beijing (CN); Shi Lei Zhang, Beijing (CN)

(73) Assignee: Nuance Communications, Inc., Burlington, MA (US)

( * ) Notice: Subject to any disclaimer, the term of this patent is extended or adjusted under 35 U.S.C. 154(b) by 941 days.

(21) Appl. No.: 13/097,191

(22) Filed: Apr. 29, 2011

(65) Prior Publication Data

US 2011/0270605 A1 Nov. 3, 2011

(30) Foreign Application Priority Data

Apr. 30, 2010 (CN) ..... 2010 1 0163229

(51) Int. Cl.
*G10L 25/48* (2013.01)

(52) U.S. Cl.
CPC ..... *G10L 25/48* (2013.01)

(58) Field of Classification Search
CPC ... G06F 17/271; G06F 17/274; G06F 17/275; G06F 17/277; G06F 17/289; G06F 17/2715; G06F 17/2735; G06F 17/2755; G06F 17/2785; G06F 17/2795; G06F 17/2818; G06F 17/2827; G06F 17/2836; G06F 17/2863; G06F 17/2872; G06F 9/4448
USPC ..... 704/1–10
See application file for complete search history.

(56) References Cited

U.S. PATENT DOCUMENTS 4,377,158 A 3/1983 Friedman et al.
4,695,962 A * 9/1987 Goudie ..... 704/267
4,783,807 A * 11/1988 Marley ..... G10L 25/90 704/234
4,799,261 A * 1/1989 Lin et al. ..... 704/219
5,305,421 A * 4/1994 Li ..... 704/219
5,396,577 A * 3/1995 Oikawa et al. ..... 704/260
5,732,395 A * 3/1998 Alexander Silverman ... 704/260
5,761,637 A * 6/1998 Chino ..... G10L 15/1807 704/231
5,890,117 A * 3/1999 Silverman ..... 704/260
6,003,005 A * 12/1999 Hirschberg ..... 704/260
6,006,175 A * 12/1999 Holzrichter ..... A61B 5/0507 704/205
6,029,131 A * 2/2000 Bruckert ..... 704/260
6,182,028 B1 * 1/2001 Karaali ..... G10L 15/18 704/10
6,505,158 B1 * 1/2003 Conkie ..... 704/260
6,601,030 B2 * 7/2003 Syrdal ..... 704/258

(Continued)

FOREIGN PATENT DOCUMENTS

CN 1726533 A 1/2006
CN 1971708 A 5/2007

(Continued)

OTHER PUBLICATIONS

Silverman, Kim EA, Mary E. Beckman, John F. Pitrelli, Mari Ostendorf, Colin W. Wightman, Patti Price, Janet B. Pierrehumbert, and Julia Hirschberg. "TOBI: a standard for labeling English prosody." In ICSLP, vol. 2, pp. 867-870. 1992.*

(Continued)

*Primary Examiner* — Fariba Sirjani
(74) *Attorney, Agent, or Firm* — Banner & Witcoff, Ltd.

(57) ABSTRACT

A method, system and computer readable storage medium for assessing speech prosody. The method includes the steps of: receiving input speech data; acquiring a prosody constraint; assessing prosody of the input speech data according to the prosody constraint; and providing assessment result where at least of the steps is carried out using a computer device.

22 Claims, 9 Drawing Sheets

(56) References Cited

U.S. PATENT DOCUMENTS

| | | | | |
|---|---|---|---|---|
| 6,625,575 | B2 * | 9/2003 | Chihara | 704/260 |
| 6,665,641 | B1 * | 12/2003 | Coorman et al. | 704/260 |
| 7,035,791 | B2 * | 4/2006 | Chazan et al. | 704/207 |
| 7,069,216 | B2 * | 6/2006 | DeMoortel et al. | 704/260 |
| 7,120,575 | B2 * | 10/2006 | Haase et al. | 704/207 |
| 7,136,816 | B1 * | 11/2006 | Strom | 704/260 |
| 7,219,059 | B2 * | 5/2007 | Gupta et al. | 704/240 |
| 7,219,060 | B2 * | 5/2007 | Coorman et al. | 704/258 |
| 7,324,944 | B2 * | 1/2008 | Hansen et al. | 704/270 |
| 7,359,856 | B2 * | 4/2008 | Martin | G10L 25/78 704/206 |
| 7,433,819 | B2 * | 10/2008 | Adams et al. | 704/251 |
| 7,454,347 | B2 * | 11/2008 | Koyama | 704/268 |
| 7,617,105 | B2 * | 11/2009 | Shi et al. | 704/260 |
| 7,761,301 | B2 * | 7/2010 | Xu | G10L 13/10 704/1 |
| 7,844,457 | B2 * | 11/2010 | Chen et al. | 704/244 |
| 7,873,522 | B2 * | 1/2011 | Du et al. | 704/275 |
| 7,899,672 | B2 * | 3/2011 | Qin | G10L 13/04 704/258 |
| 7,962,341 | B2 * | 6/2011 | Braunschweiler | 704/258 |
| 7,996,214 | B2 * | 8/2011 | Bangalore | G10L 15/1807 704/207 |
| 8,024,174 | B2 * | 9/2011 | Wang et al. | 704/6 |
| 8,175,879 | B2 * | 5/2012 | Nitisaroj et al. | 704/260 |
| 8,219,398 | B2 * | 7/2012 | Marple et al. | 704/260 |
| 8,234,118 | B2 * | 7/2012 | Pyo | G10L 13/10 704/1 |
| 8,315,870 | B2 * | 11/2012 | Hanazawa | 704/254 |
| 8,332,225 | B2 * | 12/2012 | Zhao et al. | 704/258 |
| 8,484,035 | B2 * | 7/2013 | Pentland | 704/278 |
| 8,571,849 | B2 * | 10/2013 | Bangalore et al. | 704/3 |
| 8,694,319 | B2 * | 4/2014 | Bodin | G10L 13/033 704/235 |
| 2003/0236663 | A1 * | 12/2003 | Dimitrova | G10L 17/00 704/245 |
| 2004/0067472 | A1 * | 4/2004 | Polanyi et al. | 434/178 |
| 2004/0230421 | A1 * | 11/2004 | Cezanne et al. | 704/207 |
| 2005/0071163 | A1 * | 3/2005 | Aaron et al. | 704/260 |
| 2005/0119894 | A1 | 6/2005 | Cutler et al. | |
| 2005/0177369 | A1 * | 8/2005 | Stoimenov et al. | 704/260 |
| 2005/0182625 | A1 * | 8/2005 | Azara | G06F 17/279 704/236 |
| 2005/0187772 | A1 * | 8/2005 | Azara | G10L 13/10 704/260 |
| 2005/0267758 | A1 * | 12/2005 | Shi | G10L 21/04 704/260 |
| 2006/0015326 | A1 * | 1/2006 | Mori | G06F 17/2863 704/9 |
| 2006/0057545 | A1 | 3/2006 | Mozer et al. | |
| 2006/0074655 | A1 * | 4/2006 | Bejar | G10L 15/063 704/243 |
| 2006/0074659 | A1 | 4/2006 | Adams et al. | |
| 2006/0136225 | A1 | 6/2006 | Kuo et al. | |
| 2006/0149558 | A1 * | 7/2006 | Kahn | G10L 15/063 704/278 |
| 2007/0055526 | A1 * | 3/2007 | Eide et al. | 704/260 |
| 2007/0083357 | A1 * | 4/2007 | Moore et al. | 704/4 |
| 2007/0213982 | A1 * | 9/2007 | Xi | G10L 15/26 704/243 |
| 2007/0250318 | A1 | 10/2007 | Waserblat et al. | |
| 2008/0059190 | A1 * | 3/2008 | Chu et al. | 704/258 |
| 2008/0177543 | A1 * | 7/2008 | Nagano et al. | 704/253 |
| 2008/0319727 | A1 * | 12/2008 | Horvitz | G06F 9/4443 703/13 |
| 2009/0204398 | A1 * | 8/2009 | Du et al. | 704/231 |
| 2009/0258333 | A1 * | 10/2009 | Yu | 434/157 |
| 2010/0004931 | A1 | 1/2010 | Ma et al. | |
| 2010/0161327 | A1 * | 6/2010 | Chandra et al. | 704/235 |
| 2010/0174533 | A1 * | 7/2010 | Pakhomov | G10L 15/005 704/205 |

FOREIGN PATENT DOCUMENTS

| | | | |
|---|---|---|---|
| EP | 1203366 | B1 | 8/2003 |
| WO | WO 02/50798 | A2 | 6/2002 |
| WO | WO2004053834 | | 6/2004 |
| WO | WO2006/125346 | A1 | 11/2006 |

OTHER PUBLICATIONS

Wang, Michelle Q., and Julia Hirschberg. "Automatic classification of intonational phrase boundaries." Computer Speech & Language 6, No. 2 (1992): 175-196.*

Syrdal et al. "Inter-Transcriber Reliability of ToBI Prosodic Labeling" 2000.*

Ma et al. "Automatic Prosody Labeling Using Both Text and Acoustic Information" 2003.*

"An automatic prosody labeling system using ANN-based syntactic-prosodic model and GMM-based acoustic-prosodic model," K Chen, M Hasegawa-Johnson, A Cohen, Acoustics, Speech, and Signal Processing, 2004. Proceedings.(ICASSP'04, Montreal, Canada, 509-512.).*

Rao et al., "Word boundary detection using pitch variations", Fourth International Conference on Spoken Language, 1996. ICSLP 96. Proceedings. Oct. 3-6, 1996, vol. 2, pp. 813-816.*

Shi, Qin, et al., "Combining Length Distribution Model with Decision Tree in Prosodic Phrase Prediction," IBM China Research Lab, Beijing, China, Interspeech 2007, pp. 1029-1032.*

A prosody only decision-tree model for disfluency detection. E Shriberg, RA Bates, A Stolcke—Eurospeech, 1997.*

Audhkhasi et al., "Automatic Evaluation of Spoken English Fluency". ICASSP, 2009. pp. 4829-4832.

Ananthakrishnan et al., "Automatic Prosodic Event Detection Using Acoustic, Lexical, and Syntactic Evidence", IEEE, Jan. 2008, vol. 16, No. 1.

Hansakunbuntheung Chatchawarn, et al., "Model-Based Automatic Evaluation of L2 Learner's English Timing", Jan. 1, 2009, Interspeech XX, XX, pp. 2855-2858, XP008139139, abstract.

* cited by examiner

ASSESSING SPEECH PROSODY

CROSS-REFERENCE TO RELATED APPLICATION

This application claims priority under 35 U.S.C. §119 from Chinese Patent Application No. 201010163229.9 filed Apr. 30, 2010, the entire contents of which are incorporated herein by reference.

BACKGROUND OF THE INVENTION

This invention generally relates to a method and system for assessing speech, in particular, to a method and system for assessing prosody of speech data.

Speech assessment is an important area in speech application technology, the main purpose of which is to assess the quality of input speech data. However, speech assessment technologies in the prior art mainly focus on assessing pronunciation of input speech data, namely, distinguishing and scoring pronunciation variance of speech data. Take the word "today" for example, the correct American pronunciation should be [tə 'de], whereas a reader can mispronounce it as [tu'de].

The existing speech assessment technologies can detect and correct incorrect pronunciations. If the input speech data is a sentence or a long paragraph rather than a word, the sentence or paragraph needs to be segmented first so as to perform force alignment between the input speech data and corresponding text data, and then an assessment is performed according to pronunciation variance of each word. In addition, most of the existing speech assessment products require a reader to read given speech information, which includes read text of some paragraph or read after a piece of standard speech, such that the input speech data is restricted by given content.

SUMMARY OF THE INVENTION

Accordingly, one aspect of the present invention provides a method for assessing speech prosody, the method including the steps of: receiving input speech data; acquiring a prosody constraint; assessing prosody of the input speech data according to the prosody constraint; and providing assessment result where at least of the steps is carried out using a computer device.

Another aspect of the present invention provides a system for assessing speech prosody, the system including: an input speech data receiver for receiving input speech data; a prosody constraint acquiring means for acquiring a prosody constraint; an assessing means for assessing prosody of the input speech data according to the prosody constraint; and a result providing means for providing assessment result.

A further aspect of the present invention provides a computer readable storage medium tangibly embodying a computer readable program code having computer readable instructions which when implemented, cause a computer to carry out the steps of the above method.

BRIEF DESCRIPTION OF THE DRAWINGS

The drawings referred to in this description are only for typical embodiments of the invention and should not be considered as limiting the scope of the invention.

DETAILED DESCRIPTION OF THE PREFERRED EMBODIMENTS

The prior art fails to provide an effective method and system for assessing speech prosody. Furthermore, a majority of the prior arts require readers to follow the reading of given text/speech, which limits the application scope of a prosody assessment. The present invention sets forth an effective method and system for assessing input speech. Further, the invention does not have any restriction on input speech data. In other words, a user can read certain text/speech or the user can give a free speech. Therefore, the present invention not only can assess prosody of a reader or follower, but also can assess prosody of any piece of input speech data.

The present invention not only can help a self-learner to score and correct his own spoken language, but can also assist an examiner to assess an examinee's performance during an oral test. The present invention not only can be implemented as a special hardware device such as repeater, but can also be implemented as software logic in a computer to operate in conjunction with a sound collecting device. The present invention not only can serve one end user, but also can be adopted by a network service provider so as to assess input speech data of multiple end users.

In the following discussion, a large amount of specific details are provided to facilitate to understand the invention thoroughly. However, for those skilled in the art, it is evident that it does not affect the understanding of the invention without these specific details. The usage of any of following specific terms is just for convenience of description, thus the invention should not be limited to any specific application that is identified and/or implied by such terms.

The present invention sets forth an effective method and system for assessing input speech. Further, the invention does not have any restriction on input speech data. In other words a user can read certain text/speech as well as give a free speech. Therefore, the present invention not only can assess prosody of a reader or follower, but also can assess prosody of any piece of input speech data.

The present invention not only can help a self-learner to score and correct his own spoken language, but also can assist an examiner to assess an examinee's performance during an oral test. The present invention not only can be implemented as a special hardware device such as repeater, but also can be implemented as software logic in a computer to operate in conjunction with a sound collecting device. The present invention not only can serve one end user, but also can be adopted by a network service provider so as to assess input speech data of a plurality of end users.

Figure 1:
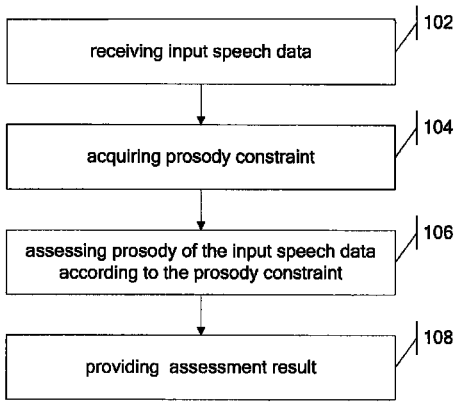
FIG. 1 shows a flow chart of a method for assessing speech prosody according to an embodiment of the present invention.

FIG. 1 shows a flow chart of a method for assessing speech prosody. First, at step 102, input speech data is received. For example, input speech data could be a sentence said by a user such as "Is it very easy for you to stay healthy in England". At step 104, prosody constraint is acquired, which can be a rhythm constraint, a fluency constraint or both. At step 106, assessment is performed on the prosody of the input speech data according to the prosody constraint, and an assessment result is provided at step 108.

Figure 2:
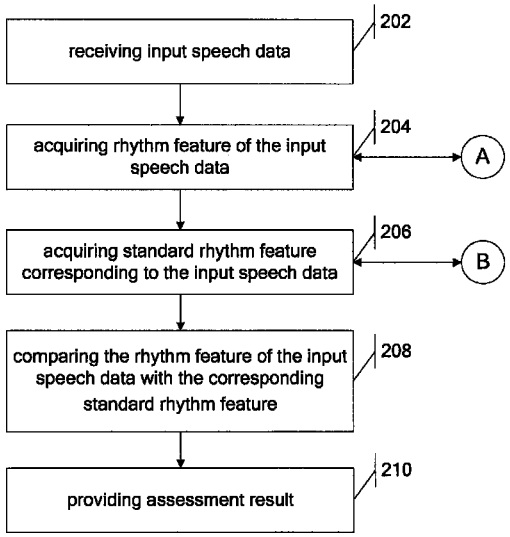
FIG. 2 shows a flow chart of a method for assessing rhythm according to an embodiment of the present invention.

FIG. 2 shows a flow chart of a method for assessing rhythm according to one embodiment of the invention. First, at step 202, the input speech data is received. Then, at step 204, the rhythm feature of the input speech data is acquired. The rhythm feature can be represented as a phrase boundary location. The phrase boundary includes at least one of the following: silence and pitch reset. Silence refers to the time interval between words in the speech data.

Figure 6A:
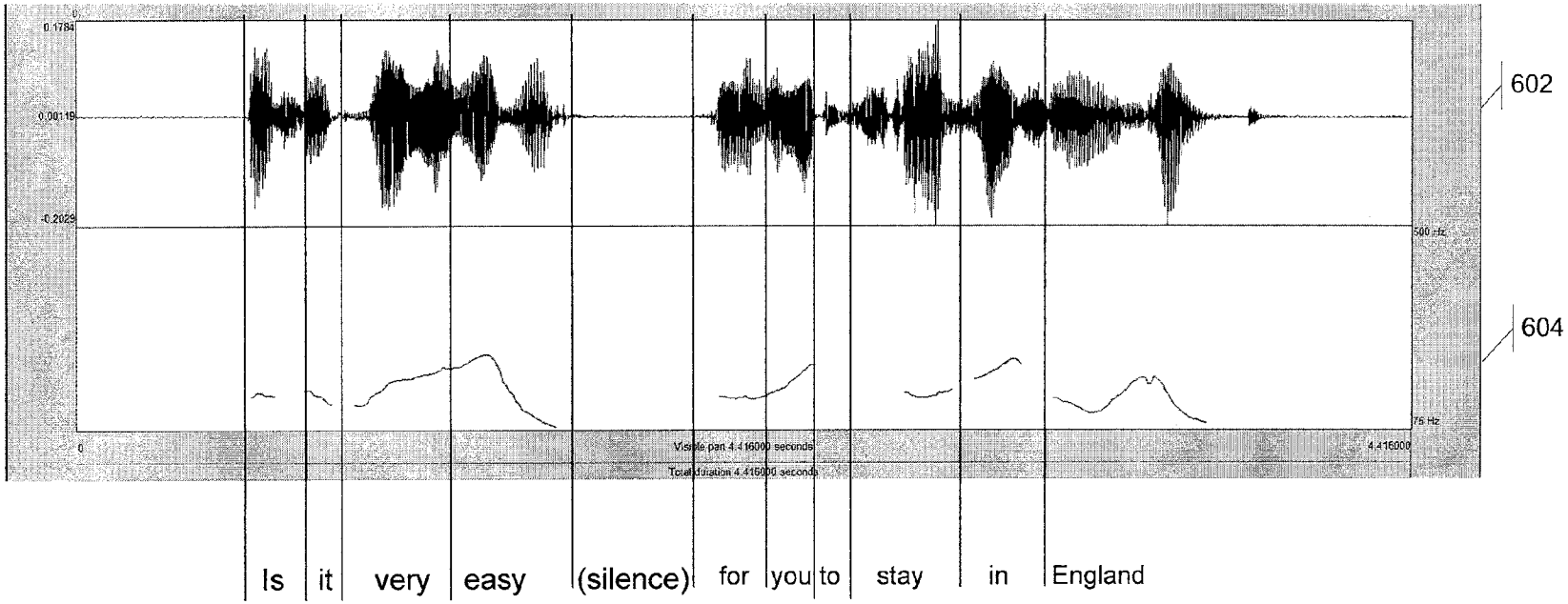
FIG. 6A shows a speech analysis chart of measuring silence of input speech data according to an embodiment of the present invention.

FIG. 6A shows a speech analysis chart which measures silence of input speech data according to one embodiment of the invention. The upper portion 602 of FIG. 6A is an energy curve varying with time that reveals a speaker's speech energy in decibel units. It can be clearly seen from FIG. 6A that, the speaker is silent for 0.463590 seconds between "easy" and "for".

Figure 6B:
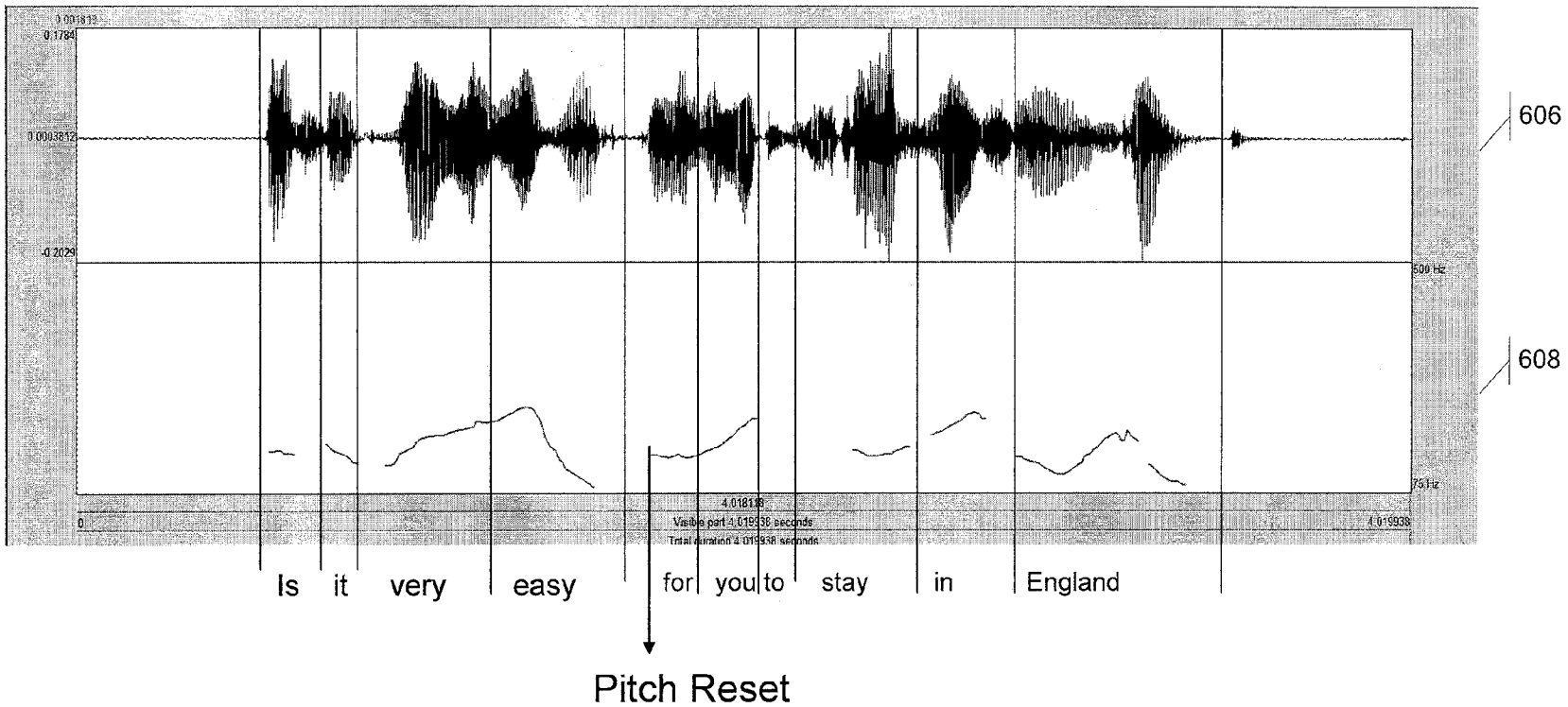
FIG. 6B shows a speech analysis chart of measuring pitch reset of input speech data according to an embodiment of the present invention.

Pitch reset refers to pitch variation between words in speech data. Usually, pitch reset can occur if the speaker needs to take a breath after finishing a word or raises the pitch of a following word. FIG. 6B shows a speech analysis chart which measures the pitch reset of input speech data according to one embodiment of the invention. The upper portion 606 of FIG. 6B is an energy curve varying with time that reveals a speaker's speech energy. The pitch variation contour shown in lower portion 608 of FIG. 6B can be derived from the energy curve. A pitch reset can be identified from the pitch variation contour. Analyzing speech data to obtain the energy curve and pitch variation contour belongs to prior art, the description of which will be omitted here. It can be known form the pitch variation contour shown at 608 that, although there is no silence between word "easy" and "for", there is a pitch reset between "easy" and "for".

For a speaker, if there is no silence or pitch reset at correct location, his reading or spoken language will not be standard or native, for example, if the speaker pauses after "very" rather than "easy", as shown in the following example:

Is it very (silence) easy for you to stay healthy in England.

Apparently, if the speaker speaks in the above way, it does not conform to normal speech rhythms. The following steps are used to judge whether a speaker pauses or makes a pitch reset at a correct location.

Figure 3:
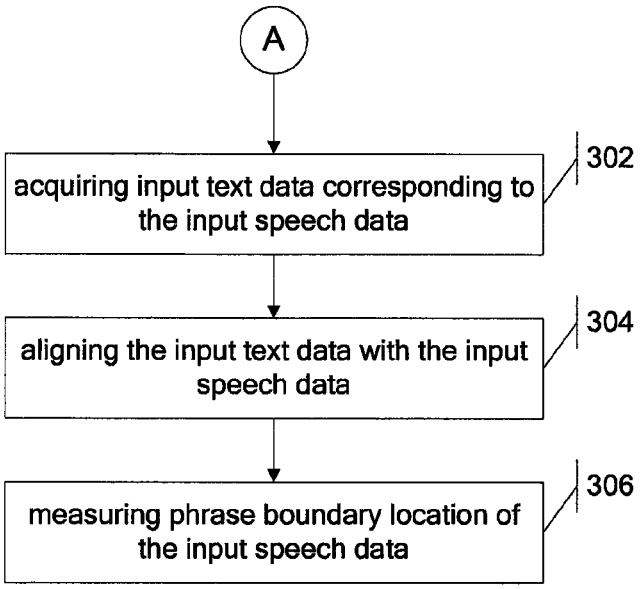
FIG. 3 shows a flow chart of acquiring rhythm feature of input speech data according to an embodiment of the present invention.

FIG. 3 shows a flow chart for acquiring a rhythm feature of input speech data according to one embodiment of the invention. At step 302, input text data corresponding to the input speech data is acquired. For example, the text content of "Is it very easy for you to stay healthy in England" is acquired. The conversion of speech data into corresponding text data can be performed by using any known or unknown convention technologies, the description of which will be omitted here. At step 304, the input text data is aligned with the input speech data. In other words, each word in the speech data is made to correspond in time to each word in the text data.

The purpose of alignment is to further analyze rhythm feature of the input speech data. At step 306, the phrase boundary location of the input speech data is measured. For instance, it can measure after which word the speaker pauses or makes a pitch reset. Further, the phrase boundary location can be marked on the aligned text data, for example:

Is it very easy (silence) for you to stay healthy in England.

Back to FIG. 2, at step 206, a standard rhythm feature corresponding to the input speech data is acquired. The so-called standard rhythm feature refers to a silence or pitch reset made under standard pronunciation; or alternatively, if a professional announcer reads the same sentence, where his/her phrase boundary location should be set. Of course, for a sentence, there can be various standard phrase boundaries. For, example, the following listed probabilities can all be considered as correct or standard reading manner:

Is it very easy (silence) for you to stay healthy in England.

Is it very easy for you to stay healthy (silence) in England.

Is it very easy for you to stay healthy in England (there is no silence or pitch reset in the whole sentence).

The present invention is not only limited to assess a speaker's input speech data according to one standard reading manner; rather, it can perform assessment by comprehensively considering various standard reading manners. Details about the step of acquiring standard rhythm feature will be given below.

Figure 4:
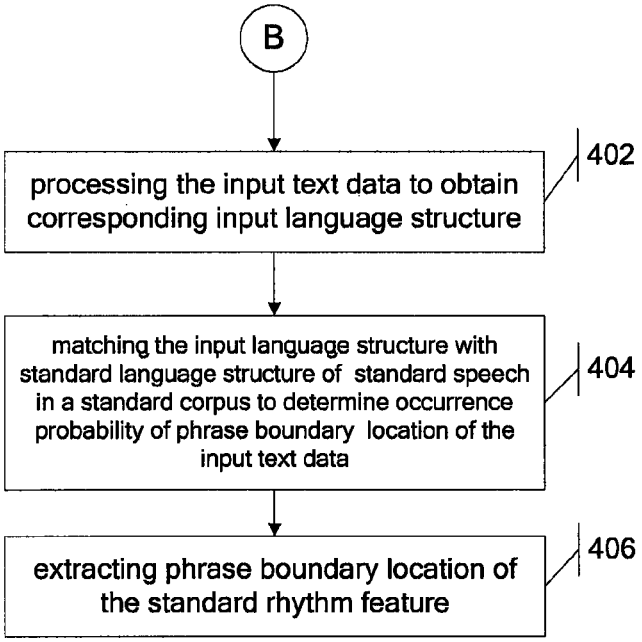
FIG. 4 shows a flow chart of acquiring standard rhythm feature according to an embodiment of the present invention.

FIG. 4 shows a flow chart of acquiring standard rhythm feature according to one embodiment of the invention. At step 402, the input text data is processed to acquire corresponding input language structure. Further, each word in the input text data can be analyzed to acquire its language structure so as to generate a language structure table of the whole sentence. Table 1 shows an example of the language structure table:

TABLE 1

| word | part of speech of current word | part of speech of left adjacent word | part of speech of right adjacent word |
|---|---|---|---|
| Is | aux | −1 | pro |
| it | pro | aux | adv |
| very | adv | pro | adj |
| easy | adj | adv | prep |
| for | prep | adj | pro |
| you | pro | prep | prep |
| to | prep | pro | vi |
| stay | vi | prep | noun |
| healthy | noun | vi | prep |
| in | prep | noun | noun |
| England | noun | prep | −1 |

Since standard speech data stored in a corpus are limited (such as tens of thousands of sentences or hundreds of thousands of sentences), it is difficult to find a sentence whose language structure is exactly the same as that of the speaker's input speech data. For example, it is difficult to find standard speech whose language structure is also "aux pro adv adj prep pro prep vi noun prep noun". Although the grammatical structure of the whole sentence can not be the same, a similar phrase boundary can exist if grammatical structure within a certain range is the same. For instance, if a standard speech data stored in the corpus is:

Vitamin c is extremely good (silence) for all types of skin.

The above sentence also has the grammatical structure of "extremely (adv) good (adj) for (prep)". Thus, the phrase boundary location that should exist in the input speech data can be deduced from phrase boundaries of standard speech with similar grammatical structure. Of course, the corpus can include numerous standard speech data with a language structure of "adv adj prep". Some of them have a silence/pitch reset after adj; while others do not have silence/pitch reset after adj. An embodiment of the present invention judges whether silence/pitch reset should occur after a word based on statistic probability of phrase boundary of numerous standard speech data with identical language structure.

Specifically, at step 404, the input language structure is matched with a standard language structure of standard speech in a standard corpus to determine the occurrence probability of phrase boundary location of the input text data. Step 404 further includes traversing a decision tree of the standard language structure according to the input language structure of at least one word of the input text data (for instance, language structure of "easy" is "adv adj prep") to determine the occurrence probability of phrase boundary location of the at least one word. The decision tree refers to a tree structure obtained from analyzing language structure of standard speech in the corpus.

Figure 5:
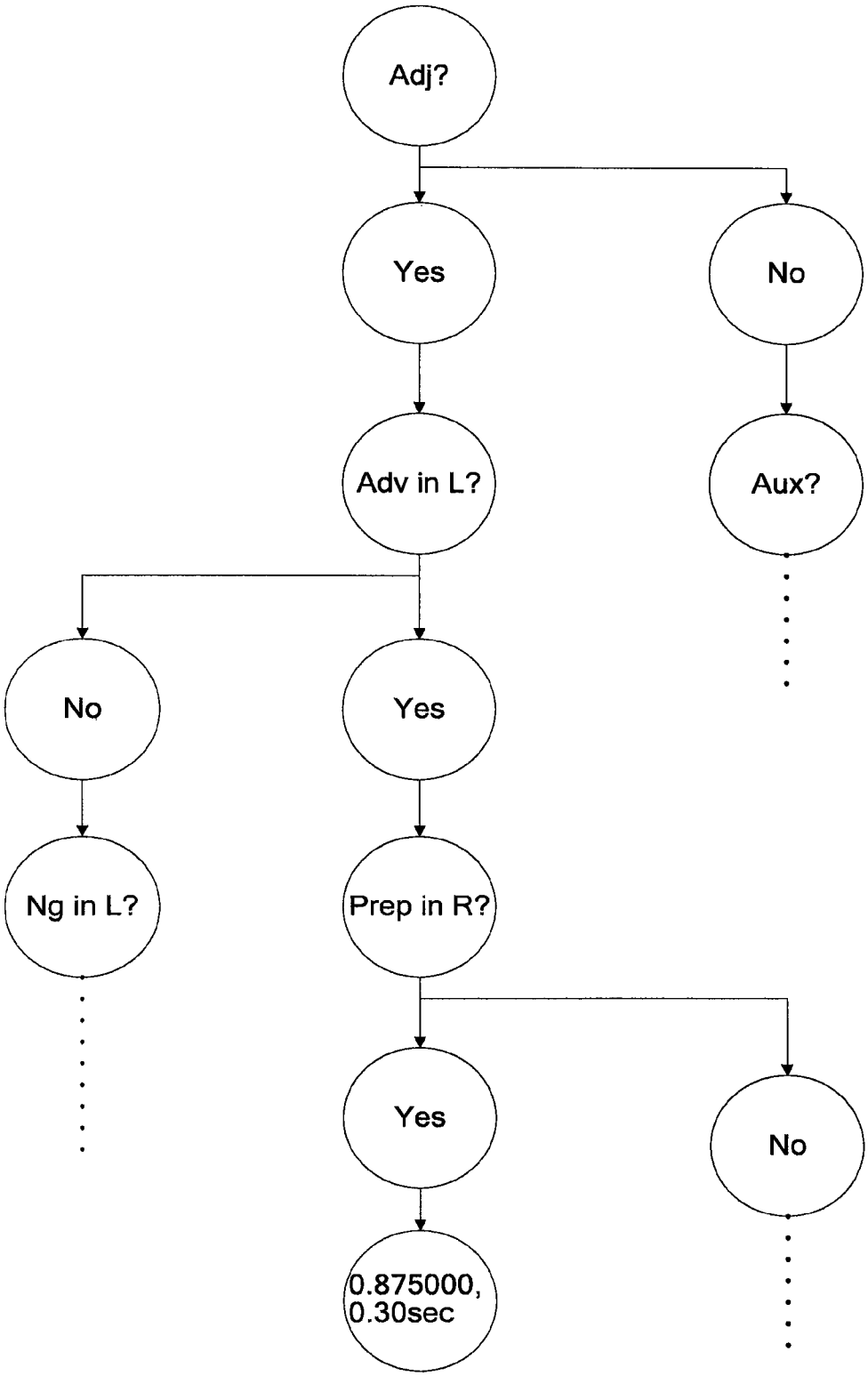
FIG. 5 shows a diagram of a portion of decision tree according to an embodiment of the present invention.

FIG. 5 shows a diagram of a portion of decision tree according to one embodiment of the invention. According to the embodiment in FIG. 5, when building a decision tree based on numerous standard speech data, it is first judged whether the part of speech of the current word is Adj. If the result is Yes, then it is further judged whether part of speech of its left adjacent word is Adv. If the result is No, it is judged whether the part of speech of the current word is Aux. If part of speech of left adjacent word is Adv, then it is further judged whether part of speech of right adjacent word is Prep; otherwise, continue to judge whether part of speech of left adjacent word is Ng. If part of speech of right adjacent word is Prep, then statistics about whether silence/pitch reset occurs after a word whose part of speech is Adj is gathered and recorded. Otherwise, it continues to perform other judgment on the part of speech of the right adjacent word. After analyzing all of the standard speeches in the corpus, statistics of leaf nodes are calculated so as to obtain the occurrence probability of the phrase boundary.

For example, in standard speech data, if silence/pitch reset occurs in 875 words with language structure "adv adj prep", and if silence/pitch reset does not occur in 125 words with language structure "adv adj prep", then occurrence probability of phrase boundary location is 0.875000. Details about the process of building a decision tree can be further found in reference document Shi et al., "Combining Length Distribution Model with Decision Tree in Prosodic Phrase Prediction", Interspeech, 2007, 454-457. It can be seen that, by traversing the decision tree according to language structure of certain words in the input text data, the occurrence probability of phrase boundary location of that word can be determined, so that the occurrence probability of phrase boundary location of each word in the input speech data can further be obtained. For example:

Is(0.000000) it(0.300000) very(0.028571) easy(0.875000) for(0.000000) you(0.470588) to(0.000000) stay(0.026316) healthy(0.633333) in(0.0513514) England(1.000000)

At step 406, the phrase boundary location of the standard rhythm feature is extracted, and the phrase boundary location whose occurrence probability is above a certain threshold is further extracted. For example, if the threshold is set at 0.600000, then the word whose occurrence probability of phrase boundary location is above 0.600000 will be extracted. According to the above example, "easy", "healthy" and "England" will all be extracted. In other words, if the silence/pitch reset occurs after "England", or silence/pitch reset occurs after any one of or both of "easy" and "healthy" in the input speech data, they can all be considered as reasonable in rhythm.

It should be noted that, the foregoing merely gives a simple example of language structure table. The language structure table can be further expanded to further include other items, such as: whether current word is at beginning, at end or in middle of a sentence, part of speech of a second word from its left, part of speech of a second word from its right, etc.

Back to FIG. 2, at step 208, the rhythm feature of the input speech data is compared with the corresponding standard rhythm feature, in order to determine whether the phrase boundary location of the input speech data matches with the phrase boundary location of the standard rhythm feature. In other words, determining whether a speaker pauses/makes a pitch reset at a location where pause/pitch reset should not be made, or whether a speaker does not pause/make a pitch reset at a location where pause/pitch reset should be made. Finally, at step 210, an assessment result is provided. According to the embodiment shown in FIG. 5A, the speaker pauses after "easy" and "England", so it conforms to a standard rhythm feature.

It is not necessary for the speaker to pause after each word whose occurrence probability of phrase boundary is above 0.600000, because this can cause too many pause times in a sentence, which will affect the coherence of the whole sentence. The present invention can adopt various predetermined assessing strategies to perform assessment based on the comparison between rhythm feature of the input speech data and corresponding standard rhythm feature.

As mentioned above, prosody can refer to rhythm of speech data, or fluency of speech data or both. The foregoing specifically describes the method for assessing input speech data in terms of rhythm feature. The following will describe a method for assessing input speech data in terms of fluency feature.

Figure 7:
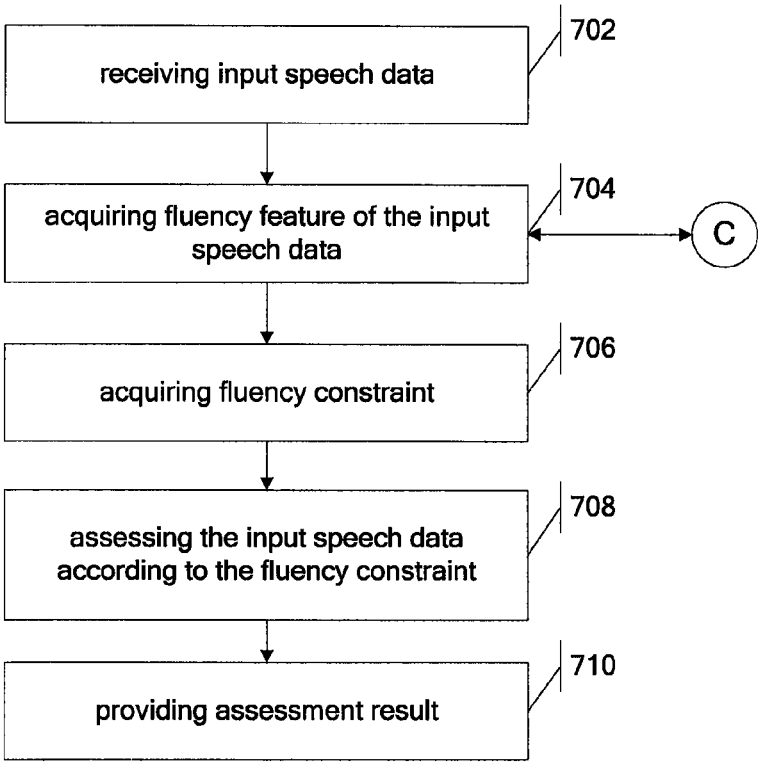
FIG. 7 shows a flow chart of a method for assessing fluency according to an embodiment of the present invention.

FIG. 7 shows a flow chart of a method for assessing fluency according to one embodiment of the invention. Input speech data is received at step 702. The fluency feature of the input speech data is obtained at step 704. The fluency feature includes one or more of the following: total number of phrase boundaries within a sentence, silence duration of phrase boundary, number of repetition times of a word, and phone hesitation degree. Fluency constraint is obtained at step 706, the input speech data is assessed according to the fluency constraint at step 708, and assessment result is provided at step 710.

Figure 8:
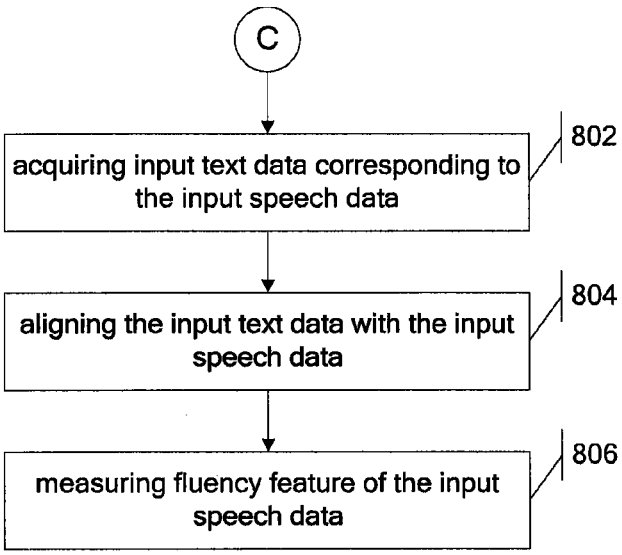
FIG. 8 shows a flow chart of acquiring fluency feature of input speech data according to an embodiment of the present invention.

FIG. 8 shows a flow chart of acquiring a fluency feature of the input speech data according to one embodiment of the invention. At step 802, input text data corresponding to the input speech data is acquired. At step 804, the input text data is aligned with the input speech data. Steps 802 and 804 are similar to steps 302 and 304 in FIG. 3, the description of which will be omitted. At step 806, the fluency feature of the input speech data is measured.

Figure 9:
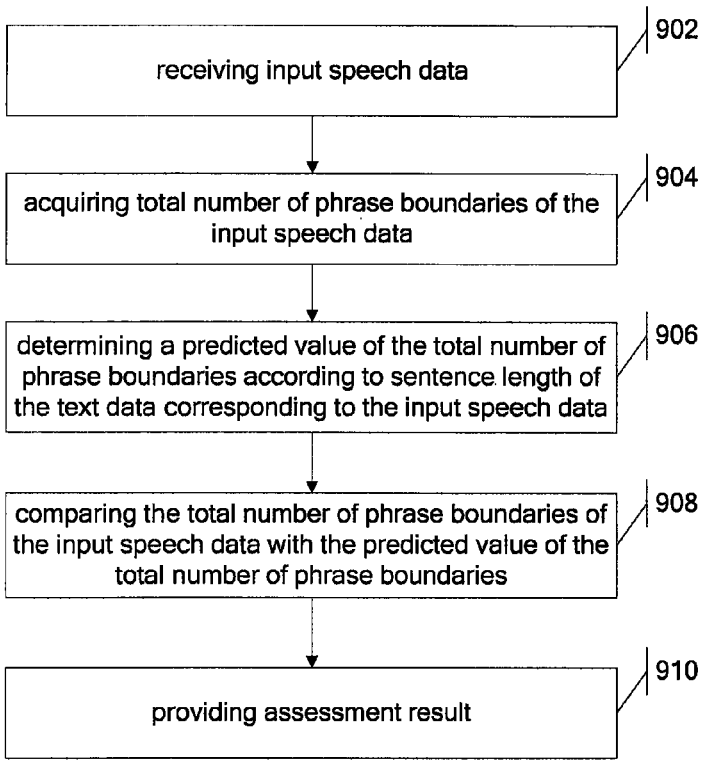
FIG. 9 shows a flow chart of a method for assessing total number of phrase boundaries according to an embodiment of the present invention.

FIG. 9 shows a flow chart of a method for assessing the total number of phrase boundaries according to one embodiment of the invention. At step 902, input speech data is received. At step 904, the total number of phrase boundaries of the input speech data is acquired. As mentioned above, the phase boundary location of several standard rhythm features can be extracted by analyzing a decision tree. However, if the pause/pitch reset is made at every phrase boundary location, fluency of the whole sentence can be affected. Thus, the total number of phrase boundaries in one sentence needs to be assessed. If a speaker speaks a long paragraph of words, how to detect end of a sentence belongs to prior art and the description of which will be omitted here.

At step 906, a predicted value of the total number of phrase boundaries is determined according to the sentence length of text data corresponding to the input speech data. In the example listed above, the whole sentence includes 11 words. For example, if a predicted value of the total number of phrase boundaries of a sentence determined based on a certain empiric value is 2, then in addition to the one pause that should be made at end of the sentence, the speaker is allowed to make, at most, one pause/pitch reset in the middle of the sentence. At step 908, the total number of phrase boundaries of the input speech data is compared with the predicted value of the total number of phrase boundaries. At step 910, an assessment result is provided. If the speaker speaks as follows:

Is it very easy (silence) for you to stay healthy (silence) in England (silence).

Then although the assessment result of his/her rhythm feature can be good, the assessment result of the fluency feature can have problem.

Figure 10:
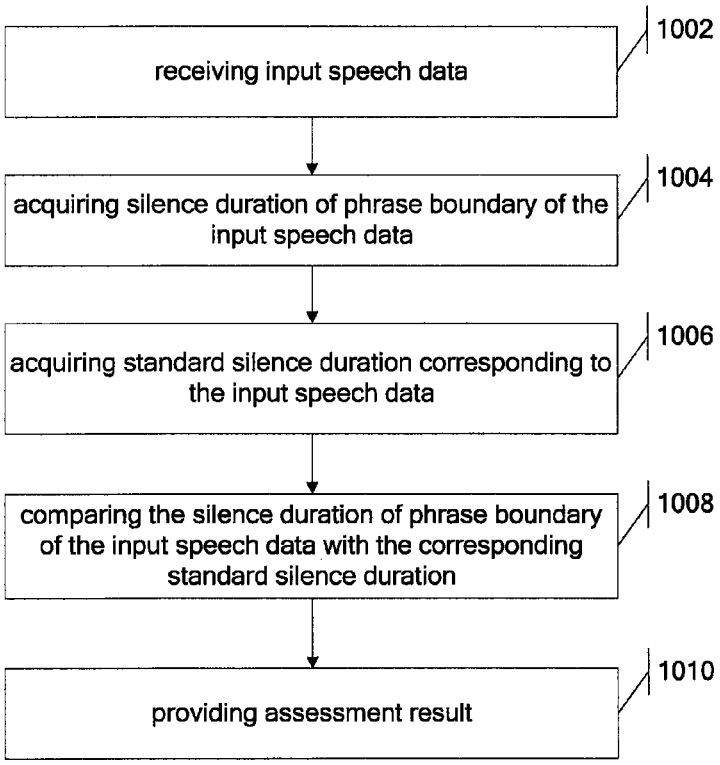
FIG. 10 shows a flow chart of a method for assessing silence duration according to an embodiment of the present invention.

FIG. 10 shows a flow chart of a method for assessing silence duration according to one embodiment of the invention. At step 1002, input speech data is received, and at step 1004, silence duration of phrase boundary of the input speech data is acquired. For example, the silence duration after "easy" in FIG. 5A is 0.463590 seconds. At step 1006, the standard silence duration corresponding to the input speech data is acquired. Step 1006 further includes the steps of processing the input text data to obtain a corresponding input language structure and matching the input language structure with a standard language structure of standard speech in a standard corpus to determine standard silence duration of phrase boundary of the input text data. The method for acquiring input language structure has been described in detail hereinabove and the description of which will be omitted here.

The step of determining standard silence duration further includes the step of traversing a decision tree of the standard language structure according to input language structure of at least one word of the input text data to determine standard silence duration of phrase boundary of the at least one word, wherein the standard silence duration is an average value of the silence duration of phrase boundary of standard language structures for which statistics have been gathered.

Take the decision tree in FIG. 5 for example, when building the decision tree, not only are statistics about occurrence probability of phrase boundary of every word of the standard speech data in the corpus gathered, but also statistics about the silence duration are gathered so as to record the average value of silence duration. For example, the average silence duration of phrase boundary of "adj" in language structure "adv adj prep" is 0.30 second, thus, 0.30 second is the standard silence duration of the language structure "adv adj prep". At step 1008, the silence duration of the phrase boundary of the input speech data is compared with the corresponding standard silence duration, and assessment result is provided at step 1010 based on a predetermined assessing strategy. For example, the predetermined assessing strategy can be the following: when the actual silence duration significantly exceeds the standard silence duration, the score of assessment result will be reduced. At step 1010, an assessment result is provided.

Figure 11:
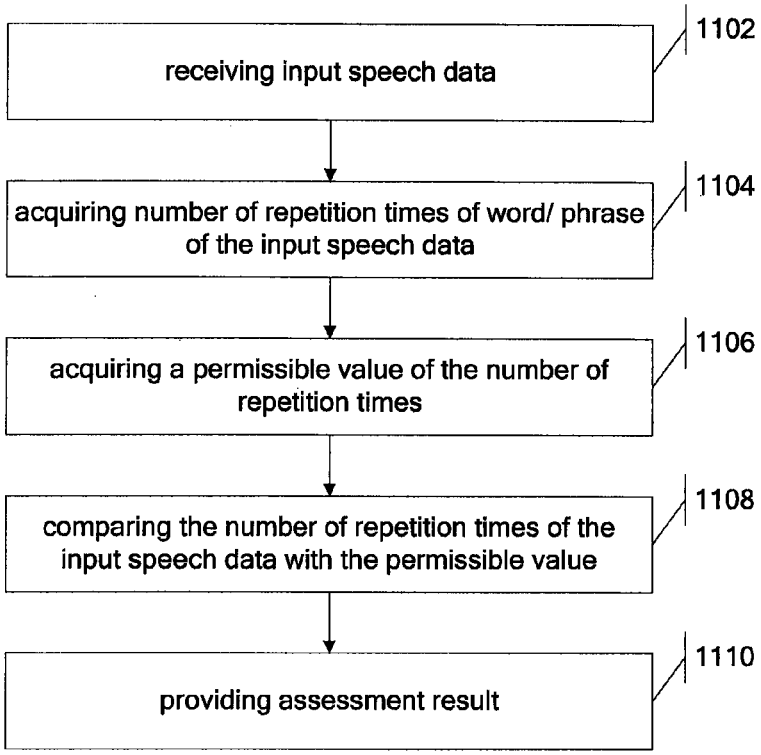
FIG. 11 shows a flow chart of a method for assessing number of repetition times of a word according to an embodiment of the present invention.

FIG. 11 shows a flow chart of a method for assessing the number of repetition times of a word according to one embodiment of the invention. At step 1102, input speech data is received, and at step 1104, the number of repetition times of a word in the input speech data is acquired. For instance, a person who has a speech impediment usually has a problem in fluency. Therefore, his language fluency can be assessed according to number of repetition times of a word or phrase within one sentence or one paragraph. The number of repetition times in the present invention refers to repetition which results from a lack of fluency in speech; it does not include repetitions intentionally made by the speaker to emphasize certain word or phrase. Repetition due to lack of fluency differs from repetition for emphasis in speech feature since the former usually will not have pitch reset during repetition, while the latter often has pitch reset accompanied with it. For example, in the above example, if the input speech data is the following:

Is it very very easy for you to stay healthy in England.

No pitch reset occurs between the two instances of "very", therefore the repetition of "very" can be caused by lack of fluency. If the input speech data is:

Is it very (pitch reset) very easy for you to stay healthy in England.

Then, the repetition of "very" can be caused by an emphasis intentionally made by the speaker. At step 1106, a permissible value of the number of repetition times is acquired (for example, a word or phrase can be repeated once in a paragraph at most); and at step 1108, the number of repetition times of the input speech data is compared with the permissible value. At step 1110, an assessment result of the comparison is provided.

Figure 12:
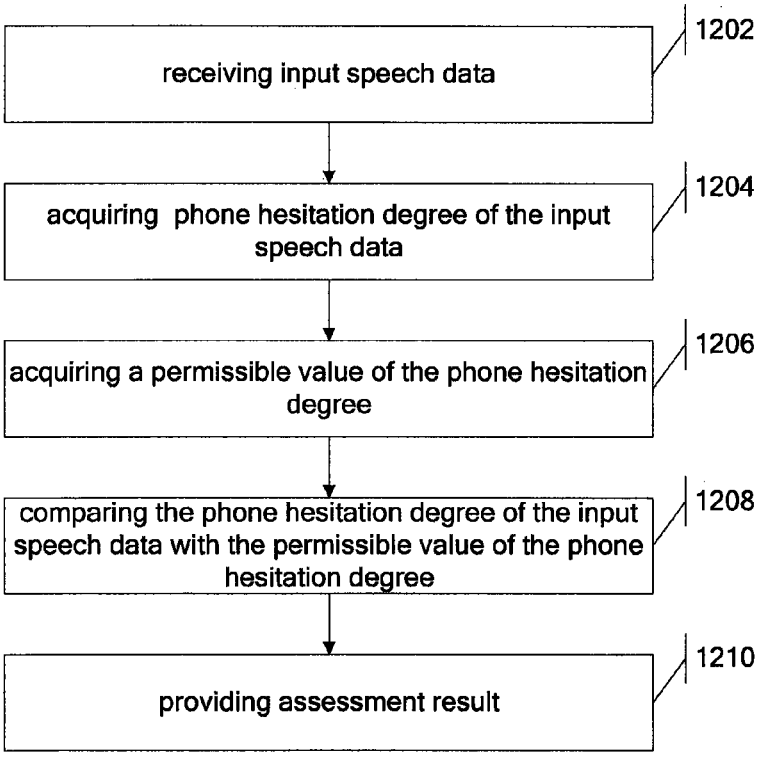
FIG. 12 shows a flow chart of a method for assessing phone hesitation degree according to an embodiment of the present invention.

FIG. 12 shows a flow chart of a method for assessing phone hesitation degree according to one embodiment of the invention. At step 1202, input speech data is received. At step 1204, the phone hesitation degree of the input speech data is acquired. The phone hesitation degree includes at least one of a number of phone hesitation times or phone hesitation duration. For example, if a speaker prolongs the short vowel [i] of word "easy", it can affect his oral/reading fluency. At step 1206, a permissible value of the phone hesitation degree is acquired (for example, the maximum number of phone hesitation times or the maximum phone hesitation duration allowed within one paragraph or sentence). At step 1208, the phone hesitation degree of the input speech data is compared with the permissible value of the phone hesitation degree. Finally at step 1210, an assessment result of the comparison is provided.

Figure 13:
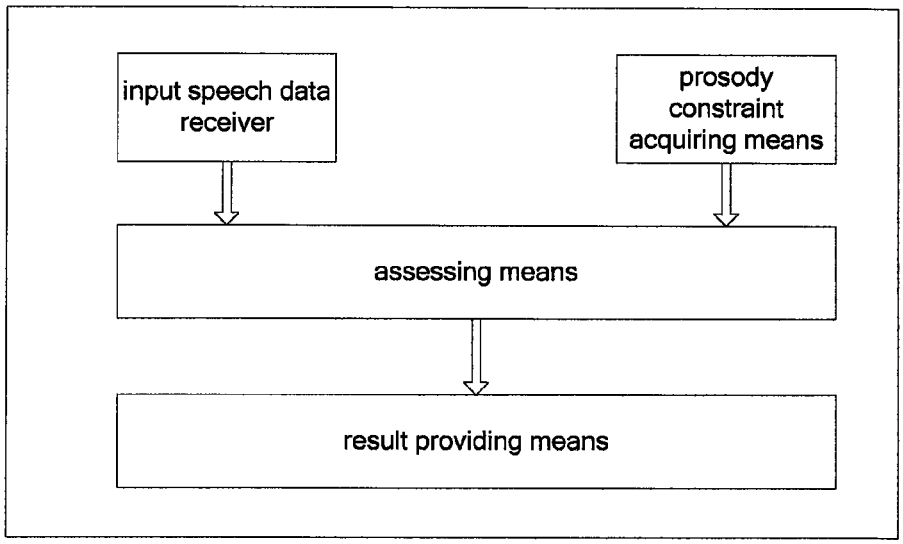
FIG. 13 shows a block diagram of a system for assessing speech prosody according to an embodiment of the present invention.

FIG. 13 shows a block diagram of a system for assessing speech prosody. The system includes an input speech data receiver, a prosody constraint acquiring means, an assessing means, and a result providing means, wherein the input speech data receiver is for receiving input speech data, the prosody constraint acquiring means is for acquiring prosody constraint, the assessing means is for assessing prosody of the input speech data according to the prosody constraint, and the result providing means is for providing assessment result.

The prosody constraint includes one or more of rhythm constraints or fluency constraints. The system can further include a rhythm feature acquiring means (not shown in the figure) for acquiring rhythm feature of the input speech data. The rhythm feature is represented as phrase boundary location. The phrase boundary includes at least one of silence and pitch reset. In addition, the prosody constraint acquiring means is further used for acquiring standard rhythm feature corresponding to the input speech data. The assessing means is further used for comparing the rhythm feature of the input speech data with the corresponding standard rhythm feature.

According to another embodiment of the present invention, the system further includes a fluency feature acquiring means (not shown in the figure) for acquiring the fluency feature of the input speech data, and the prosodic feature acquiring means is further used for acquiring input text data corresponding to the input speech data, aligning the input text data with the input speech data, and measuring fluency feature of the input speech data.

Other functions performed by the system for assessing speech prosody shown in FIG. 13 corresponds to respective steps in the method for assessing speech prosody as described above, the description of which will be omitted here.

It is to be noted that, the present invention can only assess one or more rhythm features of the input speech data, or can only assess one or more fluency features or can perform a comprehensive prosody assessment by combining one or more rhythm features and one or more fluency features. If there is more than one assessed item, different or same weights can be set for each different assessed item. In other words, different assessment strategies can be established based on actual need.

Although the present invention provides a method and system for assessing speech prosody, it can also be combined with other method and system for assessing speech. For instance, the system of the present invention can be combined with another speech assessing system such as a system for assessing pronunciation and/or a system for assessing grammar so as to perform a comprehensive assessment on the input speech data. The result of prosody assessment of the present invention can be taken as one item of the comprehensive speech assessment and be assigned a certain weight.

According to one embodiment of the invention, based on the assessment result, an input speech data with a high score can be added into the corpus as standard speech data, thereby further enriching the quantity of standard speech data.

Figure 14:
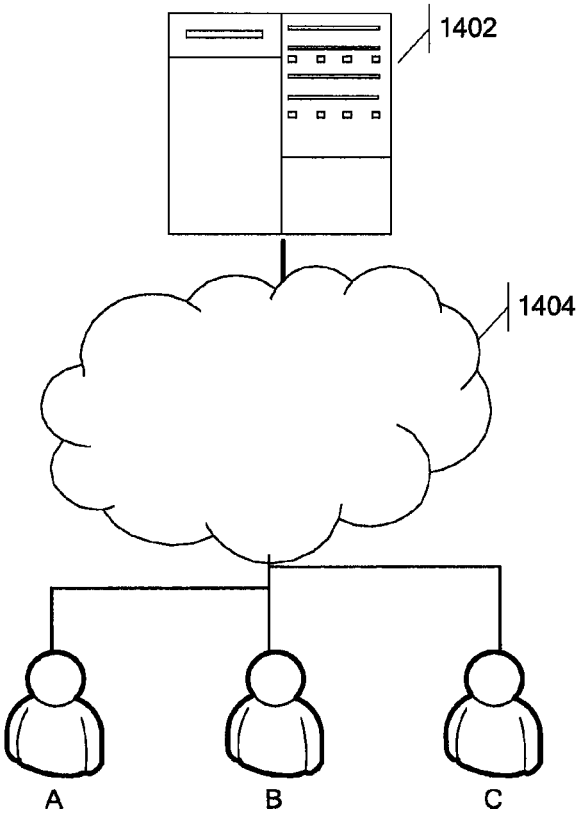
FIG. 14 shows a diagram of performing speech prosody assessment in manner of network service according to an embodiment of the present invention.

FIG. 14 shows a diagram of performing speech prosody assessment in manner of network service according to one embodiment of the invention. A server 1402 provides service of assessing speech prosody, different users can upload their speech data to the server 1402 through a network 1404, and the server 1402 can return result of prosody assessment to the user.

According to another embodiment of the present invention, the system for assessing speech prosody can also be applied in a local computer for a speaker to perform speech prosody assessment. According to yet another embodiment of the present invention, the system for assessing speech prosody can also be designed as a special hardware device for a speaker to perform speech prosody assessment.

The assessment result of the present invention includes at least one of the following: score of prosody of the input speech data; detailed analysis on prosody of the input speech data; or reference speech data. The score can be assessed using a hundred-point system, five-point system or any other system; or descriptive score can be used, such as excellent, good, fine, or bad.

The detailed analysis can include one or more of the following: location where speaker's silence/pitch reset is inappropriate, total number of speaker's silence/pitch reset is too high, speaker's silence duration at certain location is too long, speaker's number of repetition times of some word/phrase is too high, and speaker's phone hesitation degree of some word is too high. The assessment result can also provide speech data for reference. For example, a correct way for reading the sentence "Is it very easy for you to stay healthy in England". There can be multiple pieces of reference speech data. The system of the present invention can provide one piece of reference speech data, or provide multiple pieces of speech data for reference.

Although the description above takes one English sentence as an example, the present invention has no limitation on the type of language to be assessed. The present invention can be applied to assess prosody of speech data of various languages such as Chinese, Japanese, Korean, etc. Although the description above takes speech as an example, the present invention can also assess prosody of other phonetic forms such as singing or rap.

As will be appreciated by one skilled in the art, the present invention can be embodied as a system, method or computer program product. Accordingly, the present invention can take the form of an entirely hardware embodiment, an entirely software embodiment (including firmware, resident software, micro-code, etc.) or an embodiment combining software and hardware aspects that can all generally be referred to herein as a "circuit," "module" or "system." Furthermore, the present invention can take the form of a computer program product embodied in any tangible medium of expression having computer usable program code embodied in the medium.

Any combination of one or more computer usable or computer readable medium(s) can be utilized. The computer-usable or computer-readable medium can be, for example but not limited to, an electronic, magnetic, optical, electromagnetic, infrared, or semiconductor system, apparatus, device, or propagation medium. More specific examples (a non-exhaustive list) of the computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, or a magnetic storage device.

Note that the computer-usable or computer-readable medium can even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium can be any medium that can contain, store, communicate, propagate, or transport the program for use by or in connection with the instruction execution system, apparatus, or device. The computer-usable medium can include a propagated data signal with the computer-usable program code embodied therewith, either in baseband or as part of a carrier wave. The computer usable program code can be transmitted using any appropriate medium, including but not limited to wireless, wireline, optical fiber cable, RF, etc.

Computer program code for carrying out operations of the present invention can be written in any combination of one or more programming languages, including an object oriented programming language such as Java, Smalltalk, C++ or the like and conventional procedural programming languages, such as the "C" programming language or similar programming languages. The program code can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams can represent a module, segment, or portion of code, which includes one or more executable instructions for implementing the specified logical function(s).

It should also be noted that, in some alternative implementations, the functions noted in the block can occur out of the order noted in the figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

The embodiment was chosen and described in order to best explain the principles of the invention and the practical application, and to enable others of ordinary skill in the art to understand the invention for various embodiments with various modifications as are suited to the particular use contemplated.

The invention claimed is:

1. A method for assessing speech prosody, comprising:

receiving, by a computing device, spoken speech, the spoken speech being converted into input speech data representing the spoken speech;

processing, by the computing device, the input speech data to acquire an input language structure that corresponds to the input speech data and that represents part of speech role of words of the spoken speech;

obtaining, from a corpus of standard speech data comprising at least one example of standard speech data having a matching language structure as at least a portion of the input speech data, a language structure of standard speech;

traversing a decision tree that corresponds to the language structure of standard speech based on at least a portion of the input language structure to identify, for a word in the input language structure, an occurrence probability of phrase boundary location at the word, wherein a leaf node of the decision tree identifies a determined occurrence probability of phrase boundary location for a part of speech based on a first adjacent part of speech to the left of the part of speech and a second adjacent part of speech to the right of the part of speech;

acquiring a rhythm feature and a fluency feature of the input speech data based, at least in part, on the occurrence probability of phrase boundary location for the word;

acquiring, from the corpus of standard speech data, a prosody constraint based on the rhythm feature and the fluency feature;

assessing prosody of the input speech data according to the prosody constraint;

providing an assessment result based on the prosody constraint; and the corpus of standard speech data or outputting reference speech that indicates a correct way to say the spoken speech.

2. The method according to claim 1 further comprising:

acquiring a standard rhythm feature for the input speech data; and wherein acquiring the prosody constraint comprises comparing the rhythm feature to the standard rhythm feature.

3. The method according to claim 2, wherein the rhythm feature is represented as a phrase boundary location of the input speech data.

4. The method according to claim 3, wherein comparing the rhythm feature to the standard rhythm feature comprises determining whether the phrase boundary location matches with a standard phrase boundary location.

5. The method according to claim 3, wherein acquiring the rhythm feature comprises:

acquiring input text data corresponding to the input speech data;

aligning the input text data with the input speech data; and determining the phrase boundary location based on alignment of the input text data with the input speech data.

6. The method according to claim 5, wherein acquiring the standard rhythm feature comprises:

matching the input language structure with the standard language structure of standard speech; and selecting a standard phrase boundary location for the input language structure as the standard rhythm feature based on a plurality of occurrence probabilities of phrase boundary locations wherein individual occurrence probabilities of phrase boundary locations in the plurality of occurrence probabilities of phrase boundary locations correspond to individual words in the input speech data.

7. The method according to claim 6, wherein selecting the standard phrase boundary location for the input language structure as the standard rhythm feature comprises:

determining that the occurrence probability is above a predetermined threshold.

8. The method according to claim 6, wherein matching the input language structure with the standard language structure comprises traversing the decision tree and determining, for each word in the input speech data, an occurrence probability of phrase boundary location of that word.

9. The method according to claim 1, wherein acquiring the fluency feature comprises:

acquiring input text data corresponding to the input speech data; and aligning the input text data with the input speech data.

10. The method according to claim 9, wherein:

the fluency feature comprises a total number of phrase boundaries within a sentence of the input text data;

the phrase boundary comprises a characteristic selected from the group consisting of silence and pitch reset; and acquiring the prosody constraint comprises predicting a total number of phrase boundaries based on a length of the sentence and comparing the total number of phrase boundaries to a predicted total number of phrase boundaries.

11. The method according to claim 9, wherein:

the fluency feature comprises a silence duration within a first phrase boundary;

acquiring the prosody constraint comprises determining a standard silence duration for the input speech data and comparing the silence duration to the standard silence duration; and the first phrase boundary is a phrase boundary of at least one word of the input text data.

12. The method according to claim 11, wherein determining the standard silence duration comprises:

matching the input language structure with the language structure of standard speech to determine the standard silence duration.

13. The method according to claim 12, wherein matching the input language structure with a standard language structure comprises:

traversing the decision tree to determine the standard silence duration of the first phrase boundary; and wherein the standard silence duration is an average value of a silence duration of a second phrase boundary of the language structure of standard speech.

14. The method according to claim 1, wherein:

the fluency feature comprises a repetition number wherein the repetition number represents a number of times a word is repeated within the input speech data; and acquiring the prosody constraint comprises acquiring a value indicating a permissible number of repetitions and comparing the repetition number to the value.

15. The method according to claim 1, wherein:

the fluency feature comprises a phone hesitation degree wherein the phone hesitation degree includes a metric selected from the group consisting of a count of phone hesitations and a phone hesitation duration; and acquiring prosody constraint comprises acquiring a value indicating a permissible phone hesitation degree and comparing the phone hesitation degree to the value.

16. The method according to claim 1, wherein the assessment result comprises a result selected from the group consisting of a score of prosody of the input speech data and a detailed analysis on prosody of the input speech data.

17. A system for assessing speech prosody, comprising:

one or more processors;

an input speech data an audio receiver configured to receive spoken speech; and memory storing instructions that, when executed by one of the processors, cause the system to convert the spoken speech into input speech data representing the spoken speech, process the input speech data to acquire an input language structure that corresponds to the input speech data and that represents part of speech role of words of the spoken speech, obtain, from a corpus of standard speech data comprising at least one example of standard speech data having a matching language structure as at least a portion of the input speech data, a language structure of standard speech, traverse a decision tree that corresponds to the language structure of standard speech based on at least a portion of the input language structure to identify, for a word in the input language structure, an occurrence probability of phrase boundary location at the word, wherein a leaf node of the decision tree identifies a determined occurrence probability of phrase boundary location for a part of speech based on a first adjacent part of speech to the left of the part of speech and a second adjacent part of speech to the right of the part of speech, acquire a rhythm feature and a fluency feature of the input speech data based, at least in part, on the occurrence probability of phrase boundary location for the word, acquire, from the corpus of standard speech data, a prosody constraint based on the rhythm feature and the fluency feature, assess prosody of the input speech data according to the prosody constraint, provide an assessment result based on the prosody constraint, and based on the assessment result, either add the input speech data to the corpus of standard speech data or output reference speech that indicates a correct way to say the spoken speech.

18. The system according to claim 17 wherein:

the instructions, when executed, further cause the system to acquire a standard rhythm feature for the input speech data; and acquiring the prosody constraint comprises comparing the rhythm feature to the standard rhythm feature.

19. The system according to claim 17, wherein:

the instructions, when executed, further cause the system to acquire input text data corresponding to the input speech data, and align the input text data with the input speech data.

20. The system according to claim 19, wherein:

the fluency feature is selected from the group consisting of a total number of phrase boundaries, a silence duration of a phrase boundary, a number of repetition times of a word, and a phone hesitation degree; and the phone hesitation degree includes a metric selected from the group consisting of a total number of phone hesitations and a phone hesitation duration.

21. A computer-implemented method for assessing speech prosody comprising:

receiving, by a computing device, spoken speech, the spoken speech being converted into input speech data representing the spoken speech;

processing, by the computing device, the input speech data to acquire an input language structure that corresponds to the input speech data and that represents part of speech role of words of the spoken speech;

obtaining, from a corpus of standard speech data comprising at least one example of standard speech data having a matching language structure as at least a portion of the input speech data, a language structure of standard speech;

obtaining traversing a decision tree that corresponds to the language structure of standard speech based on at least a portion of the input language structure to identify, for a word in the input language structure, an occurrence probability of phrase boundary location at the word and a silence duration of phrase boundary location at the word, wherein a leaf node of the decision tree identifies a determined occurrence probability of phrase boundary location for a part of speech and a determined average silence duration for the part of speech each based on a first adjacent part of speech to the left of the part of speech and a second adjacent part of speech to the right of the part of speech;

acquiring a rhythm feature and a fluency feature of the input speech data, wherein the rhythm feature is acquired based, at least in part, on the occurrence probability of phrase boundary location for the word and wherein the fluency feature is acquired based, at least in part, on the silence duration of phrase boundary location for the word;

acquiring, from the corpus of standard speech data, a standard rhythm feature and a standard fluency feature based on the decision tree;

performing a first comparison of the rhythm feature to the standard rhythm feature;

performing a second comparison of the fluency feature to the standard fluency feature;

obtaining a prosody assessment result based on the first and second comparisons; and based on the prosody assessment result, either adding the input speech data to the corpus of standard speech data or outputting reference speech data that indicates a correct way to say the spoken speech.

22. The computer-implemented method of claim 21 further comprising:

acquiring input text data corresponding to the input speech data; and the input language structure corresponding to the input text data.

* * * * *